United States Patent [19]

Peck et al.

[11] 4,097,939

[45] Jul. 4, 1978

[54] HOSPITAL BED

[75] Inventors: William H. Peck; Daniel R. Tekulve, both of Batesville, Ind.

[73] Assignee: Hill-Rom Company, Inc., Batesville, Ind.

[21] Appl. No.: 659,162

[22] Filed: Feb. 18, 1976

[51] Int. Cl.[2] ..... A61G 7/10

[52] U.S. Cl. ..... 5/63; 5/66; 5/68

[58] Field of Search ..... 5/62, 63, 66, 68; 108/144, 145, 147; 254/86 R

[56] References Cited

U.S. PATENT DOCUMENTS

| | | | |
|---|---|---|---|
| 2,982,050 | 5/1961 | Moy | 108/145 |
| 3,003,159 | 10/1961 | Hebert et al. | 5/63 |
| 3,036,314 | 5/1962 | Wetzler | 5/63 |
| 3,608,102 | 9/1971 | Goodman | 5/63 |
| 3,644,945 | 2/1972 | Goodman et al. | 5/63 |
| 3,676,881 | 2/1972 | Duprey | 5/63 |
| 3,924,694 | 12/1975 | Baughman et al. | 172/413 |

FOREIGN PATENT DOCUMENTS

| | | | |
|---|---|---|---|
| 2,534,452 | 8/1975 | Fed. Rep. of Germany | 5/63 |

OTHER PUBLICATIONS

Sears Roebucks Co., p. 975, Nov. 1975, Fall Catalog, FIGS. 6 & 7.

*Primary Examiner*—Casmir A. Nunberg

[57] ABSTRACT

A hospital bed having a primary frame and a mattress frame supported on casters through a parallelogram linkage and having locking devices for achieving Trendelenburg and reverse Trendelenburg positions.

20 Claims, 14 Drawing Figures

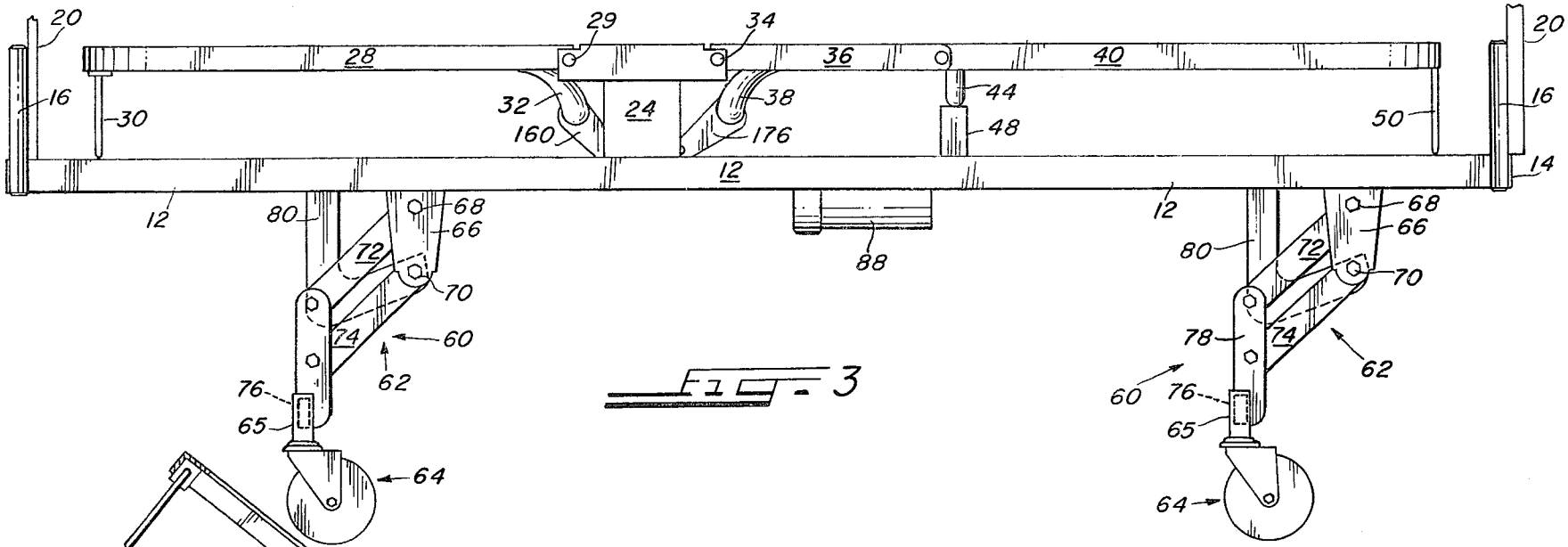
FIG. 3
FIG. 4
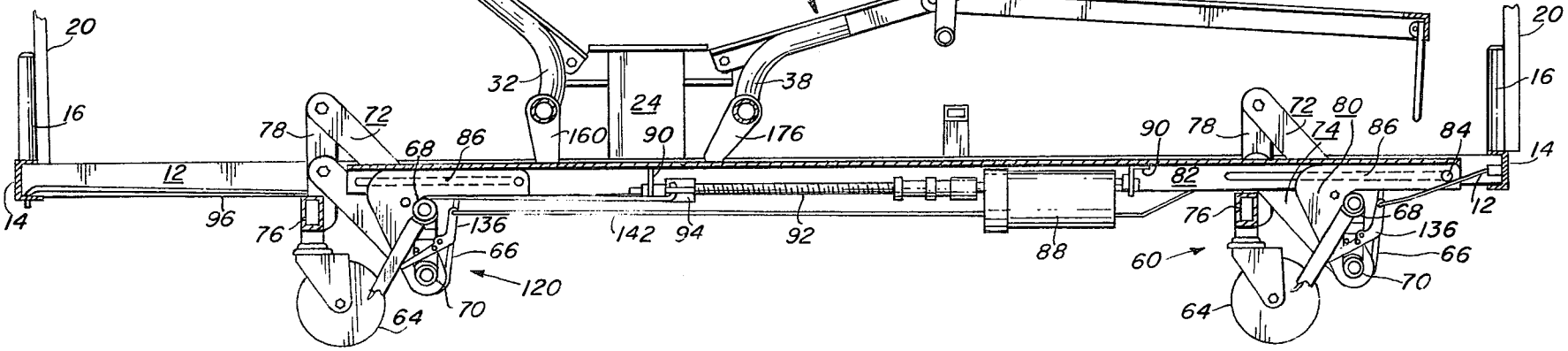

HOSPITAL BED

BACKGROUND OF THE INVENTION

This invention relates to hospital beds. Such beds are usually provided with devices for raising and lowering the patient and for permitting pivotal movement of the patient's upper body portion towards a sitting position as well as upward pivotal movement of his thighs. To accomplish these functions, most hospital beds are provided with a base support frame, a primary frame mounted upon the base frame and a mattress frame. Often, the primary frame supports electric motors and drive mechanisms for vertically moving the primary frame relative to the base frame and for pivoting the head and thigh sections of the mattress frame. Thus, three separate frames have been found desirable to accomplish the desired functions.

Hospital beds employing these three horizontal frames present some disadvantages. These primarily include difficulties in maneuverability due to length and weight, higher cost in terms of additional fabrication and assembly, and a complicated power lift linkage mechanism.

SUMMARY OF THE INVENTION

In order to overcome the disadvantages of the prior art, the instant invention relates to a hospital bed having two frames, e.g., a primary frame and a mattress frame. The primary frame is supported off of the floor by a parallelogram or four bar linkage and carries the power drive motors and linkages for accomplishing each desired movement of a hospital bed. Further, the primary frame incorporates a locking apparatus for holding a selected four bar linkage in an elevated position to achieve the Trendelenburg and reverse Trendelenburg positions.

Accordingly, it is an object of our invention to provide a hospital bed having only two frames but yet capable of each movement and position attainable by beds having three frames. Another object is to provide elevating supports for the primary frame in the form of four bar linkages mounted on casters, and capable of raising and lowering the bed with minimum force. A simple, direct power drive and linkage is provided to achieve this capability. Another object is to provide a lighter hospital bed having a shorter wheel base for greater maneuverability. Finally, it is an object of our invention to provide a durable, less costly hospital bed which has a simple locking apparatus for obtaining Trendelenburg and reverse Trendelenburg positions.

DESCRIPTION OF THE DRAWINGS

The manner in which the foregoing and other objects are attained will be made clear by a consideration of the following specifications and drawings in which:

FIG. 3 is a side elevation view of FIG. 1 depicting the bed in its elevated position;

FIG. 4 is a view similar to that of FIG. 2 but depicting the bed in its lower position with the mattress frame pivoted;

DETAILED DESCRIPTION

Figure 1:
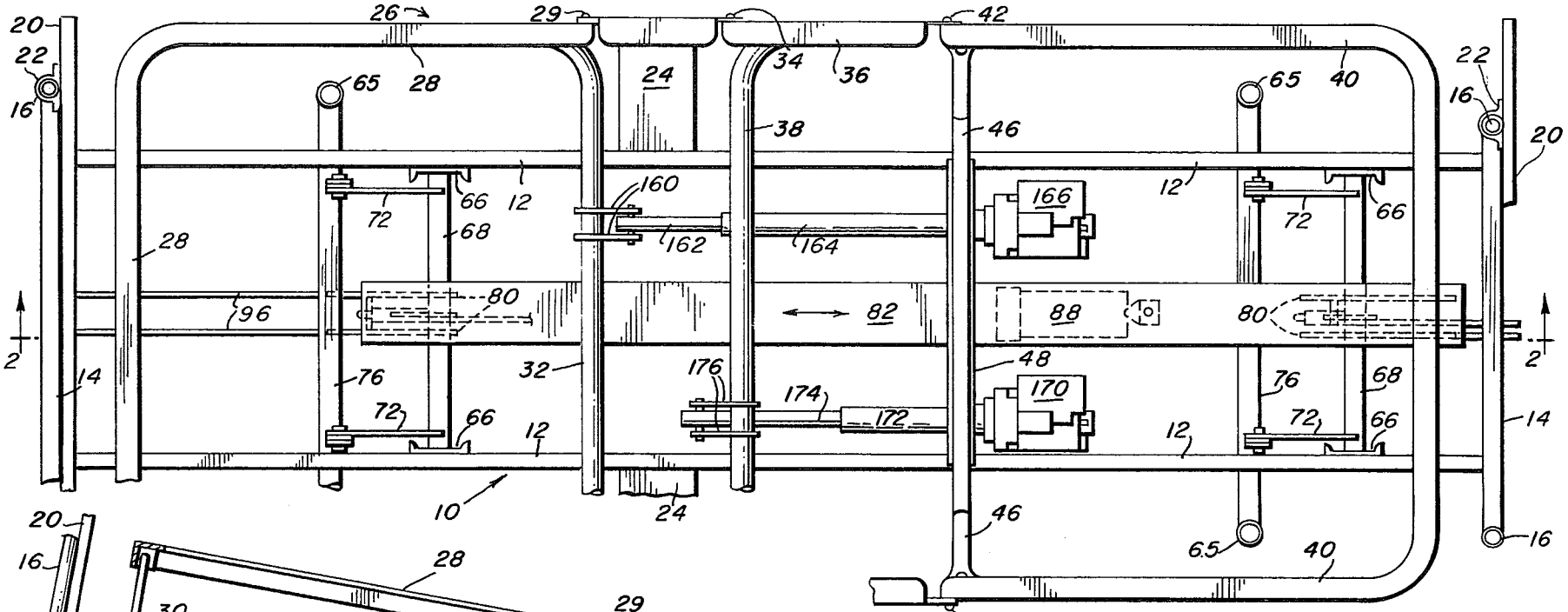
FIG. 1 is a plan view of a preferred embodiment of our invention.
Figure 2:
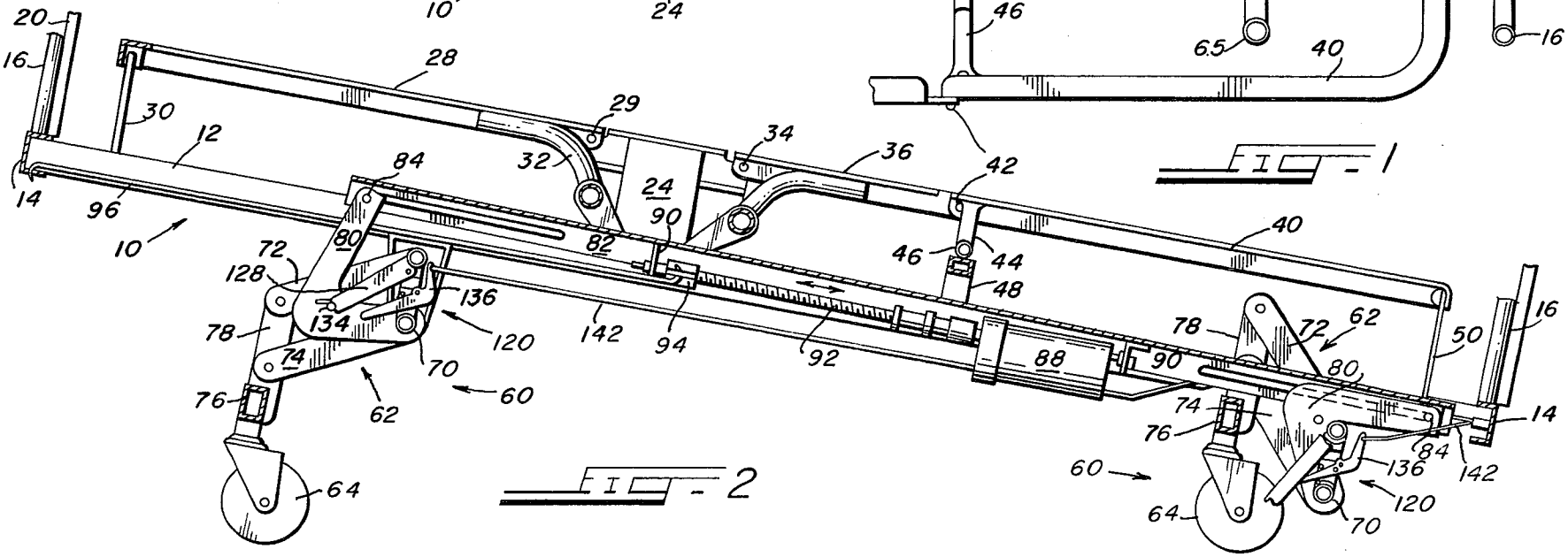
FIG. 2 is a side elevation view in section taken along the lines 2—2 of FIG. 1 and depicting the bed in a reverse Trendelenburg position.

As depicted in FIGS. 1 and 2, a preferred embodiment of our invention has a main or primary support frame 10 comprising two elongated frame members 12,12 which are interconnected at their ends by cross beams 14,14. Affixed to each cross beam are two vertical standards 16,16 which mount a head board 18 and foot board 20 through brackets 22,22.

Extending outward and upwardly from opposite sides of the main frame 10 are two support arms 24,24, one being attached to each frame member 12. These support arms pivotally mount a mattress frame 26 which includes a head section 28, thigh section 36, and a foot section 40. The head section 28 comprises a U-shaped frame whose ends are pivotally attached to arms 24 at 29,29, the upper end of head section being vertically supported in a horizontal position by a vertical support 30 which rests against frame members 12. Also attached adjacent the ends of U-shaped head section 28 is a torque tube 32 which, in a manner subsequently described, effects pivotal movement of head section 28 clockwise about pivot points 29,29.

Also attached to support arms 24,24 at pivot points 34,34 on opposite sides of the bed is a rectangular thigh section 36 of mattress frame 26 which, through another torque tube 38 affixed thereto, is adapted to be rotated counterclockwise to elevate the thighs of a hospital patient. Completing the mattress frame is a rectangular foot section 40 of a U-shape construction whose extending arms are pivotally connected at 42,42 to the opposite sides of the thigh section. Supporting thigh and foot sections 36 and 40 in a horizontal position are vertical supports 44 and 50 affixed at opposite ends of section 40. Support 44 may include a U-shaped bar whose arms depend downwardly from opposite sides of section 40 to join a bar 46 resting against a cross bar 48 extending between the main frame members 12,12. At the very foot of section 40 are additional vertical supports 50 which rest directly upon frame members 12.

As is well know in the art, counterclockwise rotation of torque tube 38 pivots the thigh section 36 upwardly about pivot points 34 simultaneously raising the forward end of foot section 40, the two sections 36 and 40 articulating about pivot points 42,42. The end of foot section 40 remains supported through members 50 against the main frame members 12, these members being reciprocated along the frame towards the head end of the bed. Alternatively, and as known in the art, linkages (not shown) affixed to the foot end of the bed may be used to elevate and support this end against articulation and in an elevated position as depicted in FIG. 4.

Prior to discussing the drive mechanisms for controlling movement of the individual mattress sections, the leg assemblies 60 which support and elevate the main frame will be described. These leg assemblies raise and lower the bed and permit attainment of the Trendelenburg and reverse Trendelenburg positions. These assemblies comprise parallelogram or four bar linkages 62 between the main frame 12 and the caster wheels 64 having spindle shaft 65.

Referring to FIG. 3, the four bar linkage includes a trunnion block 66 affixed to and depending downwardly from each frame member 12. These blocks rotatably journal two torque tubes 68 and 70 extending across main frame 10, each of which mounts a bar or linkage 72 and 74, constrained for rotation with the associated torque tube. Pivotally connected to the opposite end of each set of bars 72 and 74 is a vertical link 78. Pairs of vertical link 78 adjacent the head and foot ends of the bed are in turn affixed to cross tubes 76. The outer ends of each cross tube are provided with journals which receive the spindle shafts 65 of the casters 64. The weight of the bed and occupant is carried by the linkages 62 which transfer the load to the four vertical links 78. These links in turn transfer the load to the transverse cross tubes 76 intermediate the ends of the tubes. The load is transfered through the cross tubes to the casters 62 located at the outer extremities of the cross tubes. The cross tubes 62 have a length which places the casters outward of the main frame member 12,12 and outward of the four bar linkages. The load distributed to the floor through the casters at these locations outboard of the main frame and four bar linkages provides a stable support for the entire bed structure. The stability formerly achieved through the use of a base frame supported on the floor by casters which in turn supports a main bed frame is therefore achieved with the present invention even though the entire base frame is eliminated.

With reference to FIG. 4, a counterclockwise force applied to tube 70 will cause rotational movement of link 74 (constrained for rotation with tube 70) about its pivotal connection with vertical link 78. Through simultaneous counterclockwise rotation of the tubes 70 at each end of the bed, main frame 12 will be elevated to the raised position of FIG. 4. Moreover, the four bar linkage 62 comprising trunnions 66, bars 72 and 74 and vertical link 78, permits the caster wheels 64 and their spindles 65 to be maintained in vertical alignment. As explained by employment of this linkage, the third support frame of prior art hospital beds is eliminated but desired stability is maintained.

Moreover, the power drive linkage for raising and lowering the bed can be simplified. This simple drive linkage can best be described with reference to FIGS. 2 and 4. As suggested, vertical movement of the main frame 12 is effected by rotating the lower torque tube 70. This is effected by welding two transversely spaced generally L-shaped lever arms 80 to each lower torque tube 70. The free ends of these lever arms are pivotally connected to the depending flanges of a reciprocable U-shaped drive channel 82 by a cross pin 84 extending into an elongated slot 86 at opposite ends of reciprocal channel 82. With reference to FIGS. 2 and 4, it can be seen that leftward reciprocal movement of channel 82 will carry the pins 84 to the left, rotating lever arms 80 and torgue tube 70, thus elevating the bed. The drive force which reciprocates drive bar 82 originates with electric motor 88 which is mounted upon and moves with the channel 82. This motor 88 may be mounted in flanges 90 depending from channel 82 or by any conventional means. Extending from motor 88 along the reciprocal drive channel 82 is a threaded output shaft 92 which extends into a threaded nut 94 serving as a reaction abutment. This nut or abutment 94 is constrained against reciprocal movement by tie rods 96 which are interconnected between the end beam 14 and flanges extending from the lock nut. Thus, rotational power from motor 88 will result in drive shaft 92 threadedly engaging itself into nut 94 and pulling the motor 88 and drive channel 82 to the left elevating the bed by applying counterclockwise motion to lever arms 80. Rotational motion of motor 88 and output shaft 92 in the opposite direction will effect unthreading of shaft 92 within nut 94 permitting the bed to lower under the weight of gravity as lever arms 86 rotate in a clockwise direction. Thus, through a simple drive channel 82 and a four bar linkage 62, the preferred embodiment of our invention can be raised and lowered, the entire main frame being moved vertically.

Often it is desired to place a hospital bed in the Trendelenburg or reverse Trendelenburg positions, the latter being depicted in FIG. 2. To achieve these positions, the entire main frame 10 is first raised by motor 88 to its maximum height. Then, a unique locking apparatus 120 associated with one of the four bar linkages is engaged, and the motor is reversed. Thus, if the locking apparatus associated with the foot of the bed is engaged upon elevation of the frame, subsequent reversal of the motor will lower only the head of the bed to achieve Trendelenburg. Alternatively, the opposite locking devices may be engaged to achieve reverse Trendelenburg. As shown in FIG. 2, the bed may be taken out of either of these positions by fully elevating the bed to release the locking mechanism.

Figure 5:
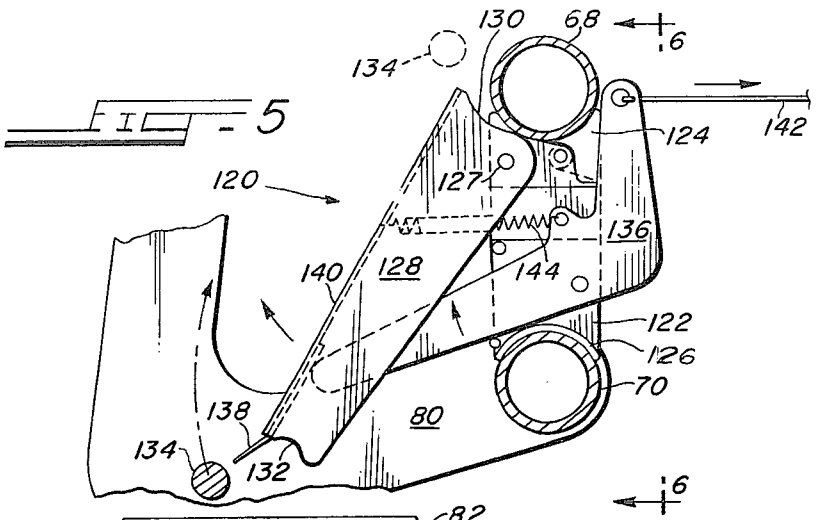

This locking apparatus 120 is described in reference to FIGS. 2 and 5–8. This apparatus is installed and supported between the torque tubes 68 and 70. It comprises a vertical support member 122 having semi-circular recesses at each end for insertion between the tubes. To facilitate insertion, the upper end may be provided with a separate locking plate 124 bolted about the circumferences of tube 68 as shown in FIG. 5. Alternately the removable plate 124 may be provided at the lower end. Preferably, the support member comprises a tubular or solid bar to achieve strength, while flange 126 is affixed to its bottom and positioned between the two transversely disposed levers 80 so as to preclude lateral movement on the torque tubes.

Figure 7:
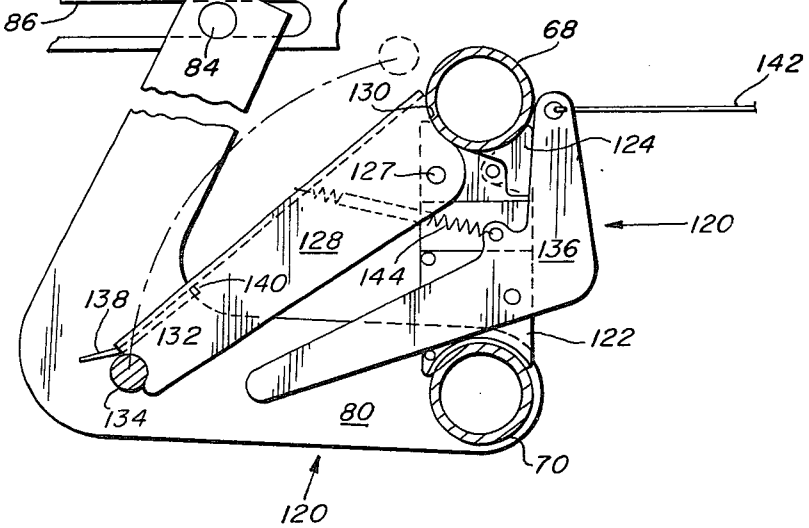
Figure 9:
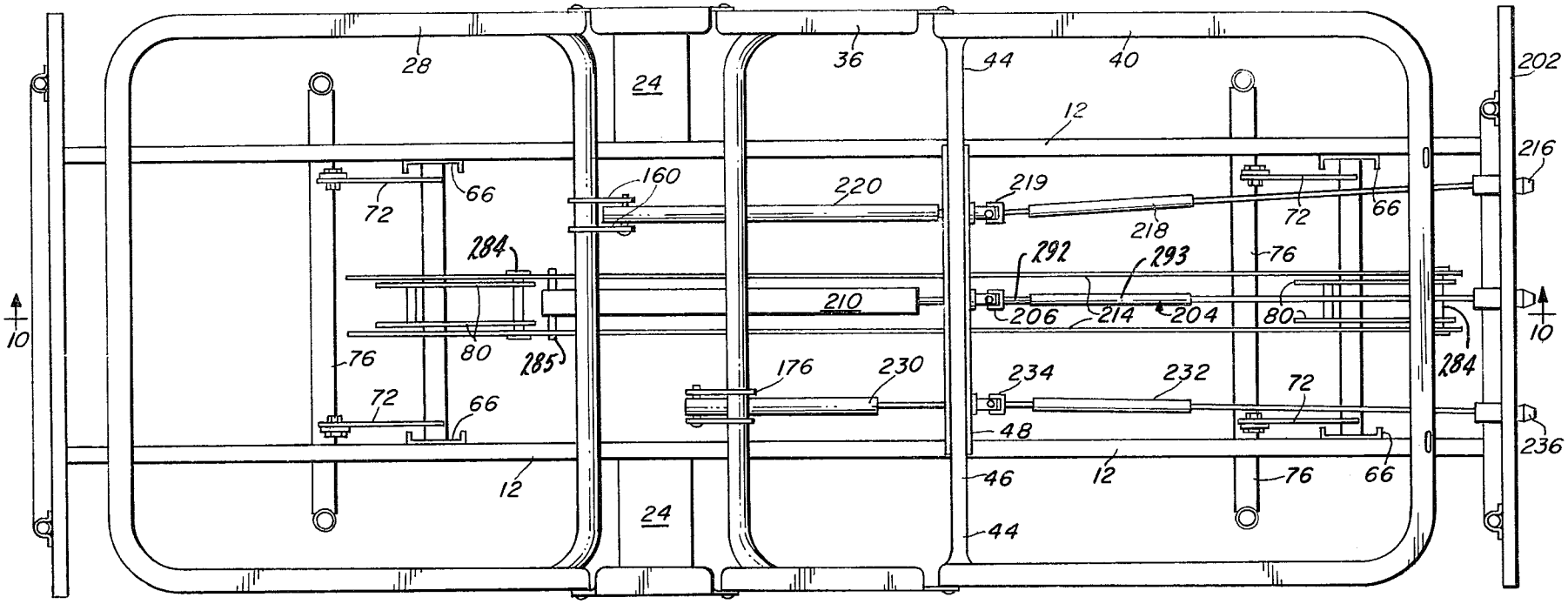
FIG. 9 is a plan view of another embodiment of our invention.

Pivotally mounted at 127 upon support member 122 adjacent its upper end is a locking bar 128. Preferably, the bar 128 has a U-shape to provide strength, and at its opposite end is provided with a semi-circular recess. The upper recess 130 is for engagement with upper torgue tube 68, while the lower recess 132 may selectively engage a pin 134 which extends between and interconnects the two lever arms 80. Referring to FIGS. 5 and 7, the leg assembly is shown in the elevated position by virtue of the levers 80 being fully rotated counterclockwise. To lower the main frame 12, levers 80 must be permitted to rotate clockwise which occurs upon reciprocation of drive bar 82 to the right. As shown in FIG. 5, nothing obstructs this clockwise movement and the bed may be lowered. However, to achieve Trendelenburg or reverse Trendelenburg, one of the leg assemblies must be held in the elevated position. Such may be accomplished by obstructing or precluding downward movement or clockwise rotation of the lever arms 80 associated with one of the leg assemblies 60. Here, the left leg assembly results in obtaining reverse Trendelenburg positioning of FIG. 2.

In the preferred embodiment of our invention, the downward or clockwise movement of lever 80 is precluded by shifting locking bar 128 into the path of pin 134 — the bar being compressed between this pin and torque tube 68, providing a solid support column to hold one end of the bed in the elevated position.

The shifting of locking bar 128 is initiated by an L-shaped actuation plate 136 pivotally mounted on support member 122. Operation of this member places the locking bar in the "ready" position.

Figure 6:
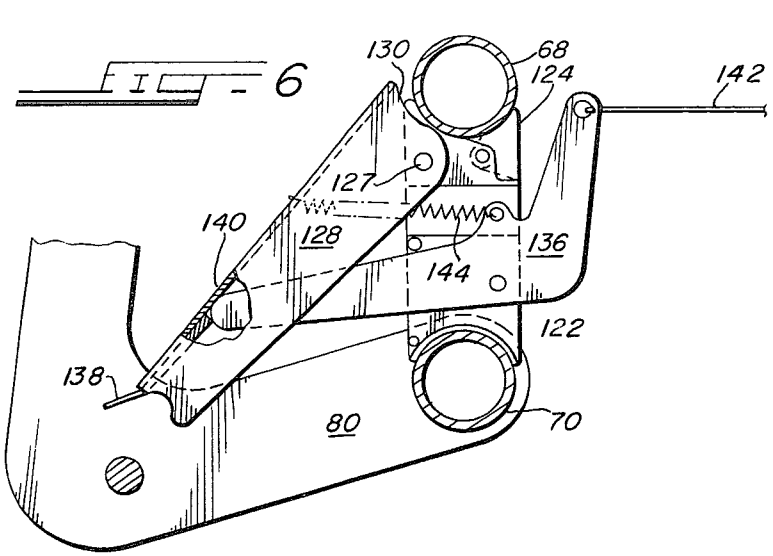
FIGS. 5, 6, and 7 are side elevation views of the locking devices utilized to hold the bed in Trendelenburg and reverse Trendelenburg positions.
Figure 8:
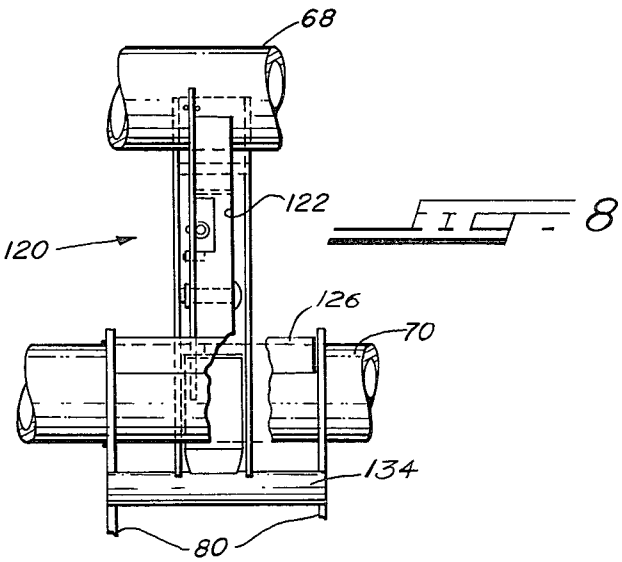
FIG. 8 is a front elevation view of the device of FIGS. 5—7.

As shown in FIGS. 5 and 6 the locking bar 128 is provided with a flexible tip 138. This tip may be formed of plastic such as "Delrin" plastic or any suitable material. "Delrin" is a trademark of E. I. DuPont and de-Meurs Company.

Actuation of the plate 136 will rotate its left end (see FIGS. 5 and 6) upward into engagement with the locking bar 128 raising the free end of the bar and placing the tab 138 in the path of the pin 134. This is the ready position.

Actuation plate 136 is rotated by a push-pull lever 142 which extends through the foot end beam 14 of the main frame (see FIGS. 2 and 4) for ease of access to the hospital attendants. A tension spring 144 is interconnected between locking bar 128 and actuation plate 136, and is effective to hold the two members in the detent or locking position prior to engagement of bar 128 with pin 134. The free end of plate 136 engages the edge 140 of the tab 138 in this position. The spring tension is adequate to hold the components in this position until the pin 134 causes a change in mode as will be explained (see FIG. 6).

It should be noted that in the ready position only the flexible tip 138 of the locking bar is in the path of pin 134. This enables selection of the Trendelenburg or Reverse Trendelenburg position by the hospital attendant at any time regardless of the condition of bed elevation. If the bed is in any position other than the full up position, bed must be adjusted to the full up position to begin movement into the desired Trendelenburg or Reverse Trendelenburg position. Such movement cuases the pin 134 to transverse its path of travel in a counterclockwise direction. Should the tip 138 of either of the locking bars be previously moved to the ready position as illustrated in FIG. 6, the pin merely deflects the tab downwardly without disturbing the locking bar. The bar is held in the ready position by the engagement of the end of the plate 136 with the edge 140 of the tip 138. Thus the bed elevation can be adjusted to full up to commence movement to the Trendelenburg or reverse Trendelenburg position without disturbing the previous adjustment of one or the other of the locking bars to the ready position.

Downward movement of the bed causes the pin 134 to move in a clockwise direction and engage the underside of the tab 138. Continued movement of the pin lifts the locking bar against the bias of the spring 144 and disengages the plate 136 from the edge 140. The plate due to the spring bias rotates counterclockwise to the normal or neutral position of FIG. 5.

As the pin 134 continues to move counterclockwise it pivots the locking bar 128 until the recess 132 engages the pin 134 and the recess 130 engages the tube 68. This places the locking bar in solid locking compression between the pin 134 and tube 68 to lock the associated four bar linkages at one end of the bed. Continued operation of the motor 88 allows the opposite end of the bed to continue in a downward path to achieve the desired Trendelenburg or reverse Trendelenburg position.

Locking of one or the other of the four bar linkages fixes the position of the L-shaped member 80 associated with that end of the bed. The opposite end of the bed is lowered by operation of the drive channel 88. Movement of the drive channel 88 is accommodated due to the "lost motion" engagement between the "L" shaped links 80 and channel 82. The pin 84 is located within slot 86. As the channel continues to move to lower one end of the bed the pin 84 associated with the links 80 at the locked end of the bed are fixed. Pin 84 slides in the slot 86 in the channel 82 to accommodate the movement of the channel.

After the bed has been placed in Trendelenburg or reverse Trenelenburg, it may be restored to the normal horizontal position by actuating motor 88 and elevating the bed to its maximum height. The bias of spring 144 will then retract locking bar 128 from its obstructing position.

In addition to the functions of raising and lowering the bed and obtaining Trendelenburg positions, the head section 28 and thigh section 36 may be pivoted about support arms 24 (see FIGS. 1 and 2). To pivot head section 28 about pivot points 29,29, two lever arms 160 are mounted upon and constrained for rotation with torque tube 32. Driving these lever arms is a threaded nut 162 which is telescoped over a threaded motor output shaft 164 of a motor 166 suspended from the cross bar support 48 in any conventional manner.

Similarly, the thigh section 36 may be pivoted about connections 34,34 by operation of another motor 170 operating through its threaded drive shaft 172 to extend and retract threaded nut 174. This latter shaft is connected to lever arms 176 constrained with torque tube 38.

The controls for operating any of the three motors 88, 166 and 170 may be connected and affixed to the foot of the bed or mounted upon support arms 24 so as to be accessible to the patient.

In the embodiments of FIGS. 1–12 the foot board and head board of the bed are removably attached. Vertical tubular members 21 are secured to cross beams 14—14 at each end of the bed. The brackets 22 define elongated apertures which receive the tubular members 21. The head and foot board may be removed by lifting in the vertical direction to slide the brackets 22 from the tubes 21.

Alternatively, the operation of the bed may be through a manual drive system such as that depicted in FIGS. 9–12. This bed has generally the same main frame 12 and mattress frame 26 together with a four bar linkage 62 for elevating the bed. However, the drive linkage for such mattress section and elevation linkage is different.

In this embodiment the lever arms 80 are connected by a pair of parallel links 214. The links 214 include slots 286 at each end which receive a transverse pin 284 associated with one set of links 80.

An expandable drive bar 210 is pivotally connected to the links 214 adjacent the links 80 associated with the head end four bar linkage at 285. At its opposite end the drive bar is provided with a drive nut 287. A drive screw 289 is journaled on the main frame within a semi-spherical thrust bearing 291. The drive screw is operatively engaged with nut 287 and rotation of the screw causes the drive bar to extend or retract with respect to the drive screw depending on the direction of rotation. Although not shown, the connection to the main frame is pivotal to the degree necessary to allow upward movement of the main frame and consequent change in angle of the drive bar 210 and screw 289.

Figure 12:
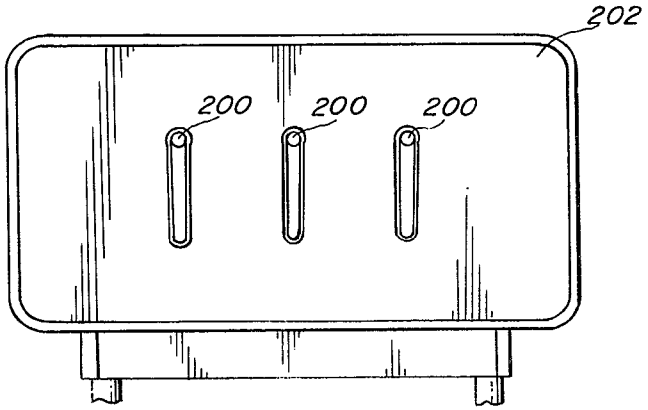
FIG. 12 is a front elevation view of the foot board of the bed of FIGS. 9—11.

Rotation of the drive screw is accomplished by the use of hand crank 200 which is normally partially recessed within footboard 202 as shown in FIG. 12. It is connected to the drive screw 289 by a telescoping linkage 204 which permits the handle 200 to be partially recessed in the headboard when not in use. This telescoping linkage includes a shaft 292 connected to screw 289 through universal joint 206. The shaft 292 includes a free end which is squared and telescopically received within tube 293 attached to crank 200. The tube is also squared and the interengagement between the squared end of shaft 292 and tube 293 provides a driving relationship. This connection is a sliding engagement. The tube 293 may be withdrawn from the shaft to permit removal of the foot board as will be explained. In this embodiment the functions of knee elevation, and head elevation are also accomplished manually. Similar cranks having telescoping connection 204 are provided.

The head section 28 is similarly pivoted by a crank 216 and extensible link 218 which, through a universal joint 219, extends and retracts a threaded telescopic rod 220 driving lever arms 160. Similarly, lever arms 176 of thigh section 36 are pivoted by telescopic rod 230 operatively driven by handle 236 through link 232 and universal joint 234. These manual driven linkages may take various forms and modifications which are within the skill of the art.

To elevate the main frame the crank 200 is rotated to cause rotation of drive screw 289. This causes nut 287 to move and extend drive tube 210. The forces developed urge links 214 toward the head end of the bed effecting counterclockwise movement of the lever arm 80. This movement operates the four bar linkage associated with each cross bar and caster assembly to raise the patient supporting platform. Lowering of the bed is accomplished by reversal of rotation of the hand crank.

Figure 10:
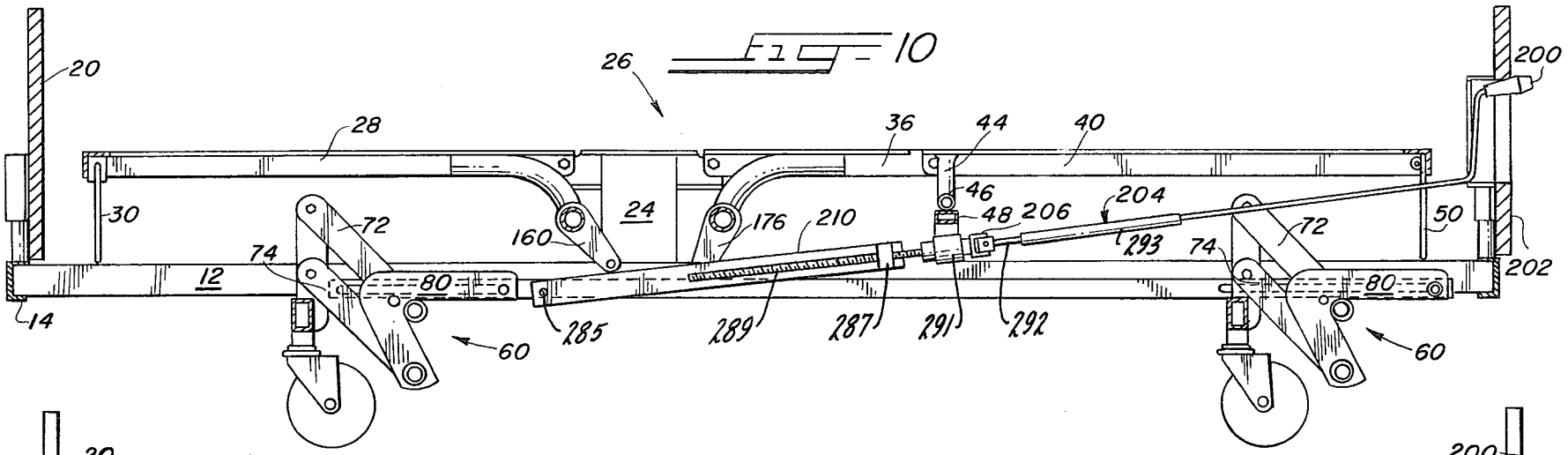
FIG. 10 is a side elevation view in section taken along the lines 10—10 of FIG. 9.
Figure 11:
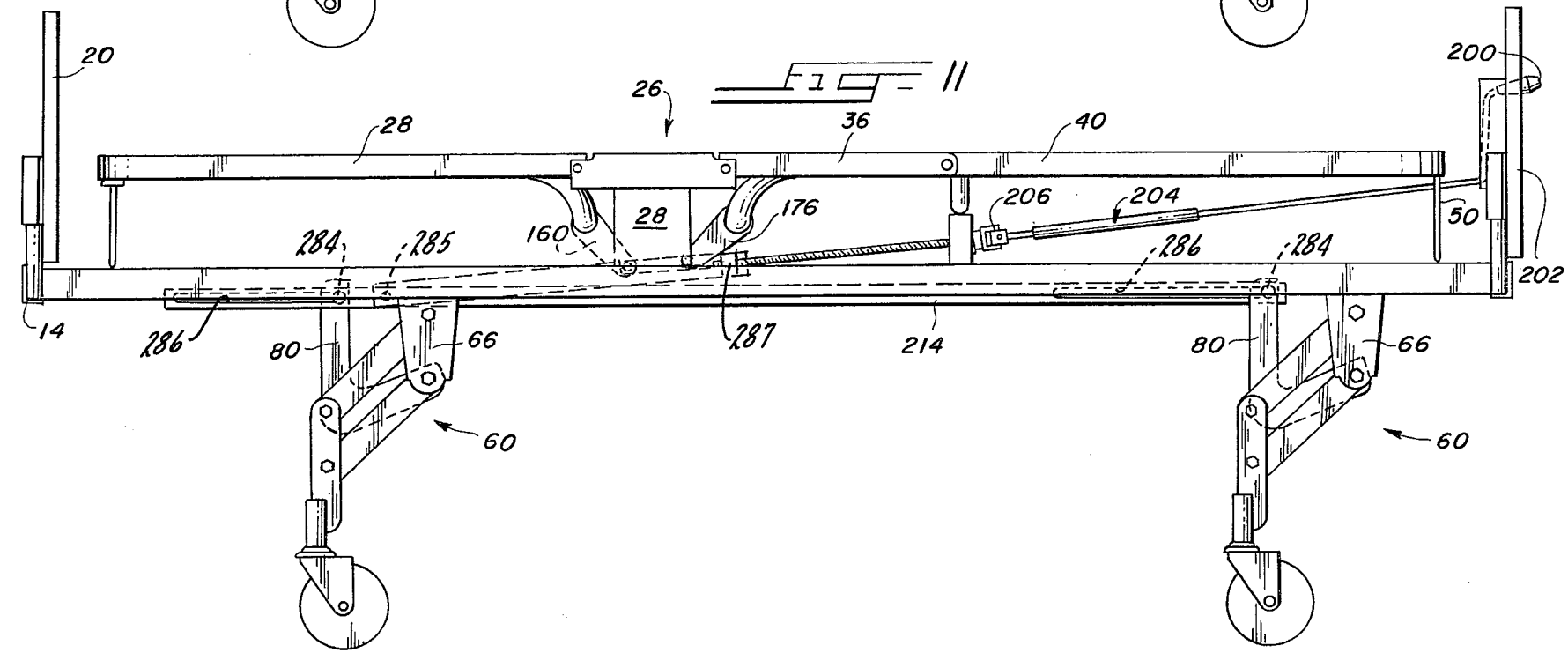
FIG. 11 is a side elevation view of FIG. 9 depicting the bed in its elevated position.

The embodiment of FIGS. 10–12 may incorporate the Trendelenburg and reverse Trendelenburg mechanism of FIGS. 5–8. These members operate in the manner previously described. The slots 286 provide for the necessary lost motion between the pins 284 and the links 214.

Figure 13:
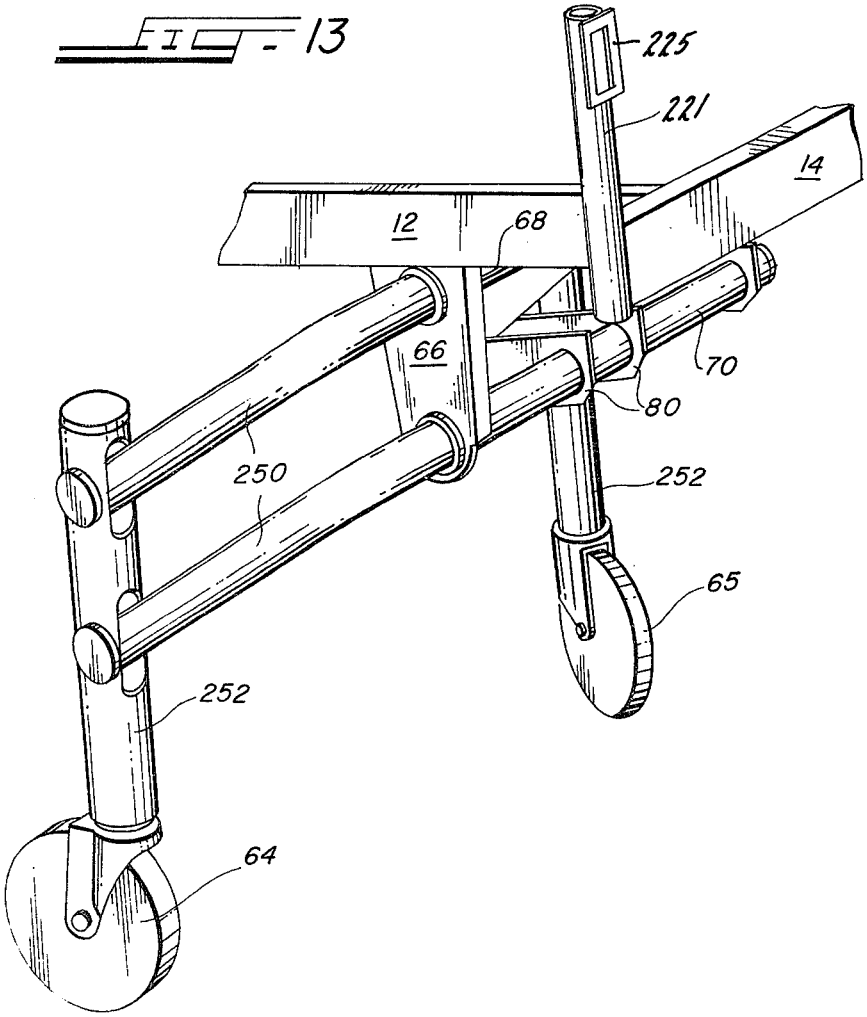
FIG. 13 is a perspective view of an alternative embodiment of the leg assembly linkage of our invention.
Figure 14:
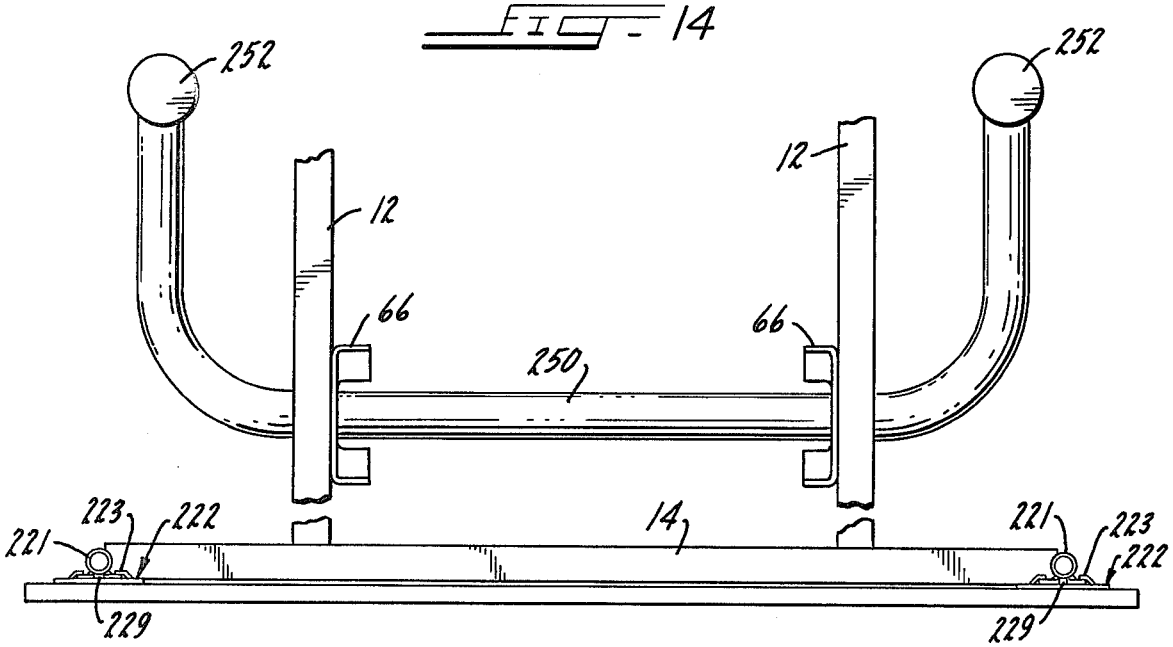
FIG. 14 is a top plan view of a detail of FIG. 13.

A further modification of the four bar lift linkage 62 is depicted in FIGS. 13 and 14. Rather than employ separate link members, the torque tubes 68 and 70 are extended through trunnions 66 and bent at a 90 degree angle to form the parallel links 250 which attach directly to a housing 252 which receives spindle shafts 65 of casters 64. The attachment between housing 252 and links 250 may comprise pivot pins passing therethrough and permitting angular movement of links 250 relative to housing 252.

Again it should be noted that the casters which support the bed upon the floor are spaced outward of the main frame. This provides maximum stability for the bed when subjected to loading adjacent the edges of the patient supporting surface. The particular position of the contact of the casters with the floor can in this embodiment be established by the degree of extension of the torque tubes from the trunnions 66. This embodiment also eliminates any cross connection between casters further improving the ease of cleaning operations.

In this embodiment the head and foot boards are secured to the main frame in a slightly modified manner. Each of the tubular member 221 include a flat plate 225 facing outwardly of the bed. Brackets 222 attached to the head board and foot board include curved channels 223 which slidably receive the plates 225 . A stop tab 229 is provided on each bracket to prevent further downward movement of the bracket, thus fixing the position of the headboard and footboard. With this arrangement any auxiliary equipment such as I.V. rods or the like placed within the vertical tubular members 221 need not be disturbed in order to remove the head end or foot end panel.

Other modifications of our invention are within he skill of the art. The four bar linkage may take several forms and the locking apparatus 120 which achieves the Trendelenburg and reverse Trendelenburg positions is subject to various modifications.

We claim:

1. A hospital bed comprising:

(a) a primary frame supporting a mattress frame;

(b) leg assemblies supporting each end of said bed, said assemblies including wheels interconnected to each end of said bed by at least one parallelogram linkage;

(c) said linkage including a mounting block depending downward from said frame, and a vertical standard extending upward from said wheels, said standard and said mounting block being interconnected by two pivotally movable parallel bars; and (d) lever means connected to at least one of said parallel bars for pivoting said bar relative to said mounting block for raising said end of said bed relative to said wheels.

2. An apparatus as recited in claim 1 in which the leg assemblies at each end of the bed are interconnected to one another to provide simultaneous, parallel lifting of the mattress frame.

3. An apparatus as recited in claim 2 in which said leg assemblies are interconnected by a reciprocable, elongated drive bar attached to said lever means.

4. An apparatus as recited in claim 2 in which said lever means is rotated by means of a manual crank having an extendable threaded shaft connected to said lever means.

5. An apparatus as recited in claim 4 in which said drive means comprises:

(a) a threaded nut fixed against reciprocal movement; and (b) a thread output shaft extending from said motor and into said nut for effecting reciprocal movement of said shaft, motor and drive bar to rotate said parallel bars.

6. An apparatus as recited in claim 1 in which said mounting blocks comprise trunnion blocks and journal two torque tubes to which said two parallel bars are attached.

7. An apparatus as recited in claim 6 in which two sets of parallel bars are attached at opposite ends to each of said torque tubes.

8. An apparatus as recited in claim 1 in which said wheels are castor wheels having spindles mounted in a cross bar on which said vertical standards are mounted.

9. A hospital bed comprising:

(a) a main rectangular frame;
(b) a mattress frame having head and thigh sections pivotally mounted on said frame;
(c) a parallelogram linkage at each end of said main frame supporting said main frame above the ground and for raising and lowering said main frame; and
(d) drive means connected to said main frame and interconnected to said linkages for raising and lowering said frame.

10. An apparatus as recited in claim 9 in which said parallelogram linkages are mounted on caster wheels.

11. An apparatus as recited in claim 9 in which said drive means includes a lever arm affixed to said parallelogram linkage for raising and lowering said bed.

12. An apparatus as recited in claim 11 in which the lever arm of the linkage at each end of the main frame is interconnected by a common reciprocable drive bar.

13. An apparatus as recited in claim 12 in which locking means are provided for each parallelogram linkage to effectively lock one of said linkages in an elevated position, said drive bar has a lost motion connection with said linkage to permit lowering of an unlocked linkage.

14. An apparatus as recited in claim 12 in which manual crank drive means are provided to reciprocate said bar and rotate said levers.

15. In a hospital bed having a main frame having two spaced apart frame members and a mattress frame supported thereon, an improved leg assembly for vertically raising and lowering said main frame comprising:
(a) trunnion blocks affixed to each of said frame members;
(b) two torque tubes extending between and journaled in said trunnion blocks;
(c) two parallel bars mounted upon said torque tubes at about a 90 degree angle and constrained for rotation therewith;
(d) a vertical link parallel to a plane passing through the axis of said torque tubes pivotally attached to said parallel bars, said vertical link being mounted on wheels; and
(e) drive means for rotating said torque tubes to raise and lower said bed.

16. An apparatus as recited in claim 15 in which a said assembly has a locking device for precluding lowering of said assembly.

17. An apparatus as recited in claim 16 in which said locking device comprises an abutment selectively movable into the descending path of a said leg assembly.

18. An apparatus as recited in claim 17 in which said abutment is movable into the path of said drive means to prevent lowering of said leg assembly.

19. An apparatus as recited in claim 3 in which an electric motor is mounted on said elongated drive bar and drive means are interconnected between said motor and said primary frame to effect reciprocal movement of said drive bar for pivoting said levers and raising and lowering said bed.

20. An apparatus as recited in claim 3 in which :
(a) said leg assemblies are provided with locking means for independently locking said linkage when said associated end of the bed is in an elevated position; and
(b) said drive bar is provided with a lost motion connection to said lever means for permitting relative movement of said drive bar with respect to said locked linkage to allow the unlocked end of the bed to be lowered upon reciprocal movement of said drive bar.

* * * * *